United States Patent [19]

Frye

[11] 4,009,779

[45] Mar. 1, 1977

[54] KIT FOR USE IN PLAYING VOLLEYBALL OR THE LIKE

[76] Inventor: Norman V. Frye, R.R. 4, Davenport, Iowa 52804

[22] Filed: May 24, 1976

[21] Appl. No.: 689,056

[52] U.S. Cl. ..... 206/315 R; 273/29 B; 52/157

[51] Int. Cl.[2] ..... B65D 85/20

[58] Field of Search ..... 206/315; 273/29 B, 29 BB, 273/29 BC, 29 BD, 29 BE, 29 BF, 29 BG, 95 H; 52/157; 150/1, 52G

[56] References Cited

UNITED STATES PATENTS

| | | | |
|---|---|---|---|
| 978,358 | 12/1910 | Cally | 206/373 |
| 2,680,514 | 6/1954 | Pierre | 206/315 R |
| 3,076,532 | 2/1963 | Frye | 52/157 |

FOREIGN PATENTS OR APPLICATIONS

| | | | |
|---|---|---|---|
| 599,727 | 3/1948 | United Kingdom | 273/95 H |

*Primary Examiner*—Herbert F. Ross

[57] ABSTRACT

A packaged kit or assemblage of components useful for the playing of volleyball or the like comprises a pair of ground anchors and a plurality of net post sections arranged in such manner that the post sections include two sets of three sections each arranged so that the six posts are parallel to each other and the ground anchors each include tubular parts strung on one post section, dual-legs means straddling the post sections, and post-supporting parts spaced from the post sections and providing a carrying handle, the kit overall being in "suitcase" form.

10 Claims, 8 Drawing Figures

KIT FOR USE IN PLAYING VOLLEYBALL OR THE LIKE

BACKGROUND OF THE INVENTION

Ground anchors of the general class referred to are known from applicant's U.S. Pat. Nos. 3,076,532; 3,197,928; 3,328,928 and 3,636,670; although none of these is capable of being packaged according to the present invention. In the prior patents, each anchor is of generally Z-shaped form, having a ground-penetrating part, usually in the form of a helix that can be screwed into the ground; a post-supporting part which stands generally upright to receive the net posts; and leg means overlying the ground and rigidly interconnecting the parts, the post-supporting being usually tubular to receive the net post either internally or externally. It was also known to provide the net post sections in two sets of three equal-length sections per set and to provide the ends of the sections in one set so as to be capable of erection in end-to-end relation for use in play, the purpose of the three-section sets being to reduce the length of the overall package as it was then known.

Because of the discrete shapes of the parts, simple packaging was virtually an impossibility, primarily because it was convenient to provide each anchor as a one-piece or otherwise integrated unit, and the resulting Z-shape was incompatible with the elongated post sections. This problem, according to the present invention, has been solved by, for one thing, making the leg between the two parts of an anchor of dual or bifurcated construction so that the leg thus formed is adapted to accommodate a plurality of post sections passed therethrough. Specifically, five of the six sections are so arranged in parallelism and passed through the legs, and the sixth post, also arranged in parallelism, is passed through the coaxial ground-penetrating helices, leaving the coaxial (on another axis) post-supporting parts, which face each other and abut end-to-end, as a carrying handle, because the six post sections are held together toward the helices by securing or holding means wrapped about the six post sections. As a further adjunct the net is packaged along with the post sections and is held by the holding means. As a further expedient, the parts serving as a handle are held together by a keeper member to prevent relative angular movement of the two about the axis of the helices.

DESCRIPTION OF A PREFERRED EMBODIMENT

Figure 1:
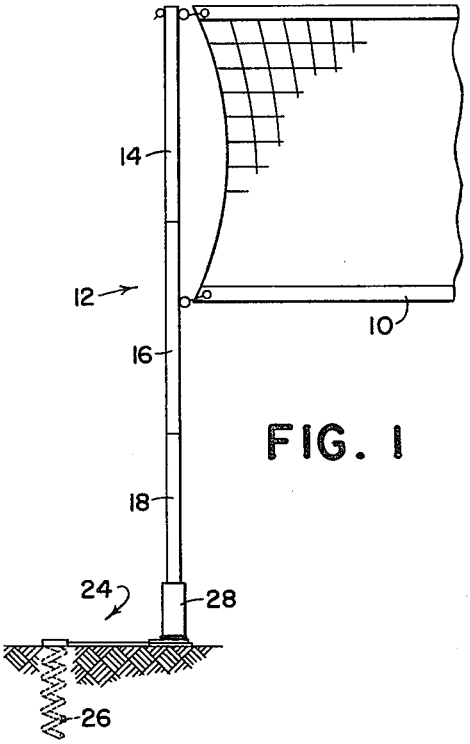
FIG. 1 is a fragmentary "environmental" view of one set of components arranged for play.
Figure 8:
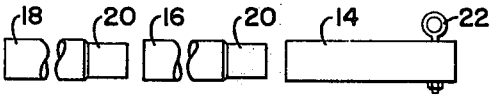
FIG. 8 is an "exploded" view, with portions broken away to conserve space, of the end-to-end relationship of a set of post sections.

FIG. 1 will be referred to first for a preliminary explanation of the components assembled for play, it being understood that a matching assembly is provided at the other end of a net 10, which is carried by a pole or post 12 made up of three end-to-end interfitting post sections 14, 16 and 18. As best shown in FIG. 8, the post sections 16 and 18 have reduced end portions 20 capable of fitting into the respective ends of the neighboring sections, the sections being tubular. The top section 14 may have an eye 22 for tying the net 10. Each post (assembled) is supported at its lower end via a ground anchor denoted in its entirety at 24. The anchor is of welded or otherwise integrated construction, having a helical — and therefore cylindrical and hollow — ground-penetrating part 26; an upright post-supporting part 28, preferably cylindrical and hollow; and a pair of co-planar legs 30 spaced apart generally on the order of at least the inside diameter of the part 26. In a preferred construction, forming the subject matter of applicant's copending application Ser. No. 689,058, filed May 24, 1976, one of the legs 30 is a continuation of the top turn of the helix 26, elongated and bent back upon itself in the form of a hairpin and welded to the helix 26, providing thus a bright 32 and cooperative plates 34 for securing the post-supporting part 28, here a short length of tubing.

Figure 2:
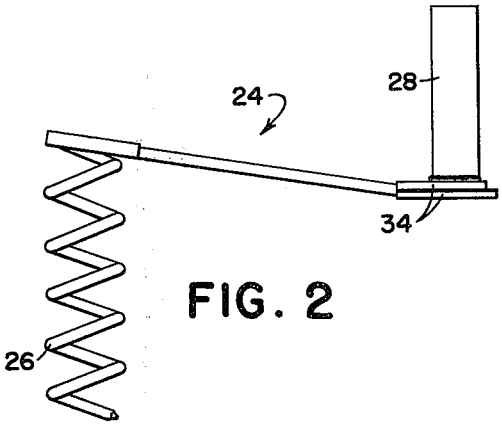
FIG. 2 is an enlarged side elevation of an anchor per se.

A difference between the anchors in FIGS. 1 and 2 will be noted. In the former the legs 30 lie flat on the ground and in the latter the legs appear to slope downwardly from the top of the helix 26 to the bight 32. This difference results from the status of the anchor initially (FIG. 2) and as used in play (FIG. 1). When the helix is screwed into the ground until the bottom plate 34 touches the ground, the anchor will assume the position of FIG. 2. After this position, the user lifts the anchor via the part 28 as a handle and continues cranking the anchor into the ground, there being enough flex in the legs 30 to permit this. A further result is that the part 28 cants toward the axis of the helix extended, but, after the post 12 is installed and the net 10 properly tensioned, the part 28 occupies a vertical position. A specific understanding of this much of the disclosure is not vital to the present invention, being the subject of the co-pending application identified above.

Figure 3:
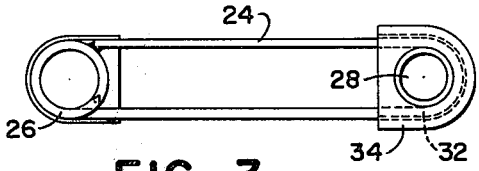
FIG. 3 is a bottom view of the anchor shown in FIG. 2.
Figure 4:
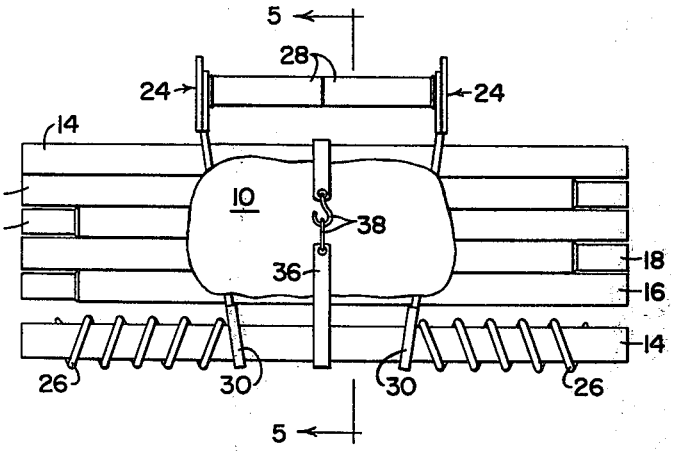
FIG. 4 is a reduced scale elevation of the kit or package.
Figure 5:
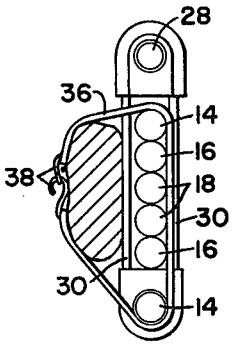
FIG. 5 is a section on the line 5—5 of FIG. 4.

The generally Z-shape of the anchor is established by the parts 28 and 26 extending in opposite directions from the legs 30. As best seen in FIG. 3, the anchors are arranged in the kit or package with the parts 28 coaxial and abutting each other, since they face each other end to end. The helices 26 are also coaxial but on a different axis and extend away from each other, or face in the directions opposite to those faced by the parts 28. One of the post sections 18 is slipped or passed through the alined helices and the other sections are passed through the spaced legs 30 and nest against each other and finally against the helices so that the arrangement is in suitcase form, the abutting parts 28 serving as a carrying handle.

Figure 6:
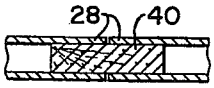
FIG. 6 is a sectional view of the keeper member in the handle.
Figure 7:
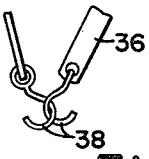
FIG. 7 is a fragmentary view showing how the holding member has its opposite ends interconnected.

A holding means, preferably in the form of an elastic strap-like element 36 having releasable connecting means, as by a pair of hooks 38 (FIG. 7), is wrapped about the six post sections, confining the sections to the position shown. A keeper member 40 (FIG. 6) may be fitted removably inside the facing tubular parts 28 to span the face-to-face abutment of the two in order to prevent relative angular movement of the parts about the axis of the helices 26. The net 10 is packaged along with the other components, being retained by the strap 36 and confined by being disposed between the axially spaced-apart legs 30 (FIG. 3).

When the kit is opened for play, the only parts not used in the game are the strap 36 and the keeper 40, besides whatever bag or the like is used to contain the net. The assemblage in kit form is easy to package, convenient to carry and makes an attractive display. The strap 36 may be a conventional tarpaulin strap of suitable length.

I claim:

1. A kit for playing volleyball or the like, comprising a pair of generally Z-shaped ground anchors, each having a generally hollow cylindrical ground-penetrating part, a post-supporting part and a pair of parallel legs extending between the parts, said parts lying generally on parallel axes and extending respectively in opposite directions from the legs, the legs being spaced apart on the order of the inside diameter of the ground-penetrating part, said anchors being arranged in the kit with their post-supporting parts coaxial and facing toward each other and the ground-penetrating parts coaxial and facing away from each other, a plurality of net post sections, including a first section passed through the coaxial ground-penetrating parts and additional sections parallel to the first section and passed through the spaced-apart legs, and means holding the anchors and posts together.

2. The invention defined in claim 1, in which the holding means confines the post sections together and toward the ground-penetrating parts to leave the post-supporting parts in spaced relation to the confined sections so that the post-supporting parts serve as a carrying handle.

3. The invention defined in claim 2, including a net disposed against the posts and held by the holding means.

4. The invention defined in claim 3, in which the legs are spaced apart lengthwise of the post sections and the net is located substantially between the legs.

5. The invention defined in claim 3, in which the holding means is a strap-like element.

6. The invention defined in claim 5, in which the element is elastic and has opposite end releasably interconnected to each other.

7. The invention defined in claim 1, in which the facing post-supporting parts respectively include aligned tubular portions facing toward each other.

8. The invention defined in claim 7, in which the facing portions abut each other and a keeper member is fitted into the tubular portions to hold said parts against relative angular displacement.

9. The invention defined in claim 8, in which the post-supporting parts are, respectively, identical lengths of tubing secured to the legs.

10. The invention defined in claim 1, in which the post sections comprise two sets of three sections per set, said sections are of substantially equal length and the three sections of each set are adapted to be assembled for play in coaxial end-to-end relation.

* * * * *